US005187054A

United States Patent [19]

Dewanckele et al.

[11] Patent Number: 5,187,054

[45] Date of Patent: Feb. 16, 1993

[54] ANTI-SLUDGING COMPOUNDS IN PHOTOGRAPHIC MATERIAL

[75] Inventors: Jean-Marie O. Dewanckele, Drongen; Emiel A. Hofman, Mortsel both of Belgium

[73] Assignee: Agfa-Gevaert N.V., Mortsel, Belgium

[21] Appl. No.: 891,744

[22] Filed: Jun. 1, 1992

[30] Foreign Application Priority Data

Jun. 24, 1991 [EP] European Pat. Off. ..... 91201605.2

[51] Int. Cl.[5] ..... G03C 1/76

[52] U.S. Cl. ..... 430/523; 430/488; 430/961; 430/929

[58] Field of Search ..... 430/488, 523, 950, 961, 430/929

[56] References Cited

U.S. PATENT DOCUMENTS

| | | | |
|---|---|---|---|
| 3,438,777 | 4/1969 | Willems et al. | 430/488 |
| 3,769,015 | 10/1973 | Itoh et al. | 430/488 |
| 3,976,875 | 10/1966 | Schwalenstocker | 430/488 |

*Primary Examiner*—Jack P. Brammer
*Attorney, Agent, or Firm*—Breiner & Breiner

[57] ABSTRACT

A photographic material is disclosed containing in a non-light sensitive layer above the emulsion layer an anti-sludging compound corresponding to following general formula (I):

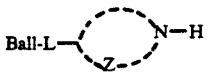

wherein Ball represents a ballast group, L represents a divalent linking group and Z represents the necessary atoms to close a heterocyclic ring with the proviso that said heterocyclic ring contains no mercapto substituent. The divalent linking group is preferably chosen from the list of —O—, —S—, —CO—$NR_1$—, —$NR_2$—$NR_3$—, —$SO_2$—$NR_4$—, —O—$CR_5R_6$—CO— NH— wherein each of $R_1$, $R_2$, $R_3$, $R_4$, $R_5$, and $R_6$ represents hydrogen, alkyl or aralkyl. The heterocyclic ring is preferably chosen from the list of imidazole, benzimidazole, 1,2,3-triazole, 1,2,4-triazole, benzotriazole, tetrazole, indazole, uracil and hydantoin.

The non-light sensitive layer, wherein the anti-sludging compound is added, is preferably the top protective layer.

8 Claims, No Drawings

ANTI-SLUDGING COMPOUNDS IN PHOTOGRAPHIC MATERIAL

DESCRIPTION

1. Field of the Invention

The present invention relates to photographic silver halide materials containing compounds able to reduce the formation of silver sludge in photographic processing solutions.

2. Background of the Invention

In the conventional formation of a photographic visible image a photographic material containing an exposed silver halide emulsion layer is subjected to a processing cycle comprising a developing, fixing, washing and drying step.

In order to permit handling of large amounts of photographic materials in a convenient way automatically operating processing machines are used to develop, fix, dry and wash exposed photographic materials. In such an apparatus the material is guided from one processing station to another by transport rollers. Loss of activity of the processing solutions as well as contamination by ingredients diffusing out of the photographic material is counteracted by continuous replenishment or by introducing fresh processing solutions periodically. However upon repeated use of the processing solutions various kinds of solid deposits can build up in these solutions in the form of a sludge which becomes attached not only to the material itself but also to parts of the processing apparatus e.g. transport rollers and other guiding means. This sludge can appear in the developing solution but also in the fixing or washing solution. In general this sludge formation is due to ingredients present in the photographic material which are leached out by the developing solution in which they form a deposit or, in the case they are soluble in the alkaline developer, are transferred to the fixing and washing compartiment where they precipitate in the form of a sludge.

A familiar and troublesome form of sludge consists of finely divided metalic silver particles, so-called silver sludge, which is formed in the developing solution. In this case it is believed that a minior part of the non-developed silver halide emulsion is dissolved by the solvent action of the developer and transported as complexed silver ions to the developer liquid. Then these complexes are decomposed and the silver ions are reduced to metallic silver which agglomerates to silver sludge particles.

In order to prevent this silver sludge formation different countermeasures are disclosed in the prior art usually consisting of particular ingredients which can be present in a processing solution or in the photographic material itself. So it has been proposed to add particular compounds forming sparingly soluble and non-reducible silver salts to the developer. For example, 5,5'-bis-1,2,4-triazolin-3-thiones or derivatives of 1,3,4-thiadiazole are described in BE 606,550 and GB 1,120,963. 2-mercapto-1,3,4-thiadiazoles are disclosed in U.S. Pat. No. 3,212,235. A great variety of other mercapto group containing compounds are described as anti-sludging agents in FR 1,470,235 and 1-phenyl-5-mercapto-tetrazole compounds having a —NHX substituent on the phenyl nucleus are disclosed in GB 1,471,554. U.S. Pat. No. 2,388,816 mentions the anti-sludging activity of some sulphonates and sulphinates, e.g. sodium-β-hydroxyethyl-aminomethane sulphonate and sodium-β-hydroxyethyl-aminomethane sulphinate.

A method for reducing sludge deposition by the combination of a developing agent, a heterocyclic mercapto compound and an anionic alkylphenoxy polyalkylenoxy phosphate is described in EP 0 223 883.

Unexamined Japanese Patent Publication (Kokai) 61-13244 discloses the use of a wide variety of heterocyclic mercapto compounds present in a non-light sensitive layer at the same side of the emulsion layer of a black-and-white photographic material.

In Unexamined Japanese Patent Publication (Kokai) 64-50047 a "cleaning film" is described comprising a non-light sensitive layer containing a compound to which silver ions or metallic silver can be adsorbed. This film can be used to clean a developer containing sludge after prolonged processing.

The present invention represents an extension of the teachings in which an anti-sludging agent is present in the photographic material itself.

It is an object of the present invention to provide a photographic material containing a member of a class of very effective anti-sludging agents.

It is a further object of the present invention to provide a photographic material which causes little or no sludge deposition on development.

Further objects of the invention will become clear from the description hereafter.

SUMMARY OF THE INVENTION

The objects of the present invention are realized by providing a photographic material comprising a support, at least one silver halide emulsion layer, and a non-light sensitive colloid layer, situated at the same side of the support and farther from said support than said emulsion layer, and containing a compound corresponding to following general formula (I):

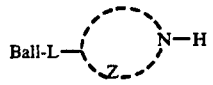

wherein:

Ball represents a ballast group preventing the diffusion of the compound out of the non-light sensitive colloid layer, e.g. a substituted or unsubstituted alkyl group of at least nine carbon atoms, or an aromatic nucleus bearing alkyl substituents containing together at least five carbon atoms;

L represents a divalent linking group e.g. —O—, —S—, —CO—$NR_1$—, —$NR_2$—CO—$NR_3$—, —$SO_2$—$NR_4$—, —O—$CR_5R_6$—CO—NH— wherein each of $R_1$, $R_2$, $R_3$, $R_4$, $R_5$ and $R_6$ represents hydrogen, alkyl or aralkyl;

Z represents the necessary atoms to close a heterocyclic ring, e.g. imidazole, benzimidazole, benzotriazole, triazole, tetrazole, indazole, uracil and hydantoin with the proviso that said heterocyclic group contains no mercapto substituent.

The non-light sensitive colloid layer containing the anti-sludging agent is preferably the top protective layer of the photographic material. It can be assumed that the anti-sludging compound forms an insoluble silver salt with the diffusing silver ions preventing in this way further diffusion of said silver ions into the developing solution.

DETAILED DESCRIPTION OF THE INVENTION

In a preferred embodiment of the present invention the heterocyclic NH-containing ring is chosen from the list of benzimidazole, 1,2,3-triazole and 1,2,4-triazole. Examples of useful compounds according to general formula (I) include:

I-1

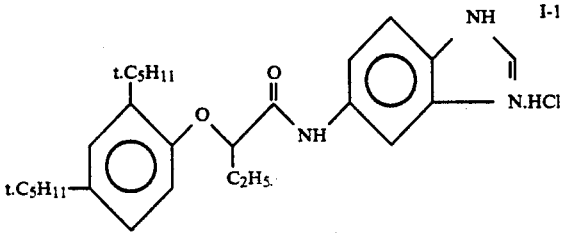

I-2

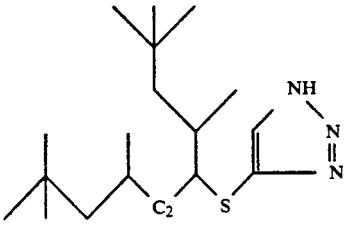

I-3

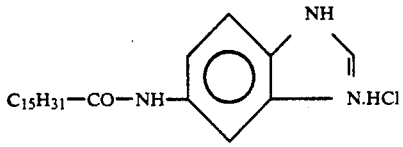

I-4

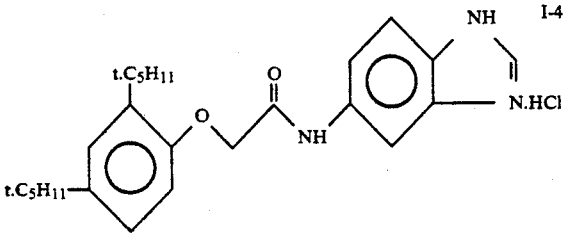

I-5

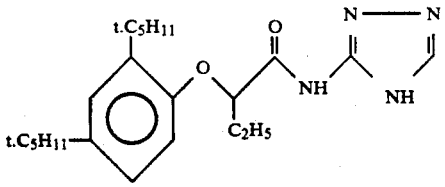

I-6

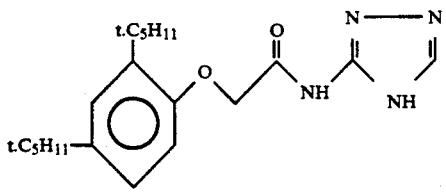

I-7

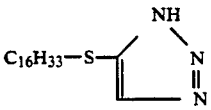

-continued

I-8

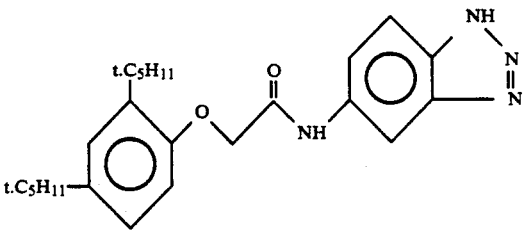

As the compounds used in accordance with the present invention are in general sparingly soluble in water they are preferably incorporated into the emulsion as solutions in organic solvents or in the form of dispersions. They can be incorporated into any non-light sensitive layer situated at the same side of the support and farther from the support than the emulsion layer, but preferably they are simply incorporated in the top protective layer. Apart from at least one emulsion layer and a protective layer the photographic material can further comprise one or more intermediate layers, backing layers and/or anti-halation layers.

In the scope of the present invention the nature and design of the photographic material is not limited to any particular application field. So the compounds in accordance with the invention can be incorporated into black-and-white or colour materials for amateur or professional photography, black-and-white or colour materials for cinematographic recording or duplication, in radiographic recording or duplicating films, in graphic arts camera or duplicating materials, in films or papers suited for exposure to laser light, in holographic materials and in diffusion transfer reversal materials.

The emulsion layer(s) of the photographic material according to the present invention can consist of one single layer but alternatively they can be double coated or even consist of multiple layers. In the case of colour materials one or more blue sensitive, green sensitive and red sensitive layers can be present.

The halogen composition of the emulsions used in connection with the present invention is not limited; so bromide, chloride, chlorobromide, iodobromide and chloroiodobromide emulsions can be used. The emulsions can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). These preparation techniques include mixing the halide and silver solutions in partially or fully controlled conditions of temperature, concentrations, sequence of addition, and rates of addition. The silver halide can be precipitated according to the single-jet method, the double-jet method, or the conversion method.

Two or more types of silver halide emulsions that have been prepared differently can be mixed for forming a photographic emulsion for use in accordance with the present invention.

The size distribution of the silver halide particles of the photographic emulsions to be used in connection with the present invention can be homodisperse or heterodisperse.

The light-sensitive silver halide emulsion can be a negative or a direct positive working emulsion. The emulsion can be a so-called primitive emulsion, in other words an emulsion that has not been chemically sensitized or it can be chemically sensitized as described e.g. in the above-mentioned "Chimie et Physique Photographique" by P. Glafkides, in the above-mentioned "Photographic Emulsion Chemistry" by G. F. Duffin, in above-mentioned "Making and Coating Photographic Emulsion" by V. L. Zelikman et al. and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioreas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, and silane compounds.

The emulsions can contain internal electron traps. Phase bounderies in so-called core-shell emulsions can act as electron traps. Metal dopants such as Pb, Cd, Hg, Pd, Tl, Ru, Rh, Ir, Bi and Cu can function as well as internal electron traps.

Other common additives well known in the photographic art can be present in the coated emulsion layer or in any other hydrophylic layer.

So-called stabilizers or anti-fogging agents can be present in the coated emulsion layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, toluenethiosulphonic acid, benzenethiosulphinic acid and benzenethiosulphonic acid amide. A revue of useful compounds is published in Research Disclosure No. 17643 (1978), Chapter VI.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. The gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966).

The binder of the photographic element, especially when the binder used is geletin, can be hardened with appropriate hardening agents such as those of the epoxide type, those of the ethylenimine type, those of the vinylsulfone type e.g. 1,3-vinylsulphonyl-2-propanol, chromiun salts e.g. chromium acetate and chromium alum, aldehydes e.g. formaldehyde, glyoxal, and glutaraldehyde, N-methylol compounds e.g. dimethylolurea and methyloldimethylhydantoin. dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion.

The photographic element of the present invention may further comprise various other additives such as e.g. compounds improving the dimensional stability of the photographic element, antistatic agents, spacing agents and plasticizers.

Antistatic agents can be used in one or more of the layers on the emulsion side or in a backing layer.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids. The presence of these compounds can minimize the amount of binder needed per square meter in order the minimize the curl when using no compensating backing layers.

Spacing agents can be present of which, in general, the average particle size is comprised between 0.2 and 10 micron. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708. Spacing agents can also serve as matting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, polyvinyl acetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic materials of the present invention can be exposed in any convenient way according to their particular application, e.g. by daylight or by artificial light like tungsten light, xenon, metal-halogen lamps, quartz-halogen lamps, by laser sources or invisible radiation like ultraviolet, X-rays and infrared.

The processing of the photographic materials of the present invention proceeds according to specifications dependent on the particular use of the material. The developer in which sludge formation is reduced by the compounds used in accordance with the invention can contain the usual photographic ingredients. So one or more developing agents can be present e.g. hydroquinone and derivatives, 3-pyrazolidinone derivatives like 1-phenyl-5-pyrazolidinone ("Phenidone") and analogues, aminophenols, hydroxylamin, hydrazine derivatives, ascorbic acid and analogues, and p-phenylene derivatives in the case of colour development. The alkali is usually potassium or sodium hydroxide. Buffering agents, organic solvents, wetting agents, development accelerating agents and sequestering agents can be present. Hardening agents of different chemical classes as enumerated above can be present, as it is the case with the numerous classes of stabilizers and anti-foggants cited above.

Is is also specifically contamplated that the developing agents can be present in the photographic material itself; in this cased the developing solution is an alkaline solution containing substantially no developing agents and is commonly termed "activator solution".

Usually the processing proceeds in an automatically driven apparatus, e.g. a RAPILINE, marketed by AGFA-GEVAERT N. V., provided with an automatic replenishment system, The following examples illustrate the present invention without limiting it thereto.

EXAMPLES

EXAMPLE 1

A control photographic material (A) containing no anti-sludging agent was prepared as follows. A silver iodobromide emulsion consisting of 97% of bromide and 3% of iodide was prepared by a conventional double jet technique. The emulsion was flocculated, washed, redispersed and chemically sensitized to an optimal fog-speed ratio by means of conventional sulphur and gold ripening agents. Then the emulsion was spectrally sensitized to the green spectral region. As stabilizers suitable amounts of 1-phenyl-5-mercapto-tetrazole and 4-hydroxy-6-methyl-1,3,3a,7-tetraazaindene were added. The emulsion was coated using conventional coating aids at a silver coverage of 2.4 g/m$^2$, expressed as $AgNO_3$, on a paper support covered on both sides with a thin layer of polyethylene. A protective top layer was coated above the emulsion layer at a gelatin coverage of 1.0 g/m$^2$. Finally a backing layer was applied containing gelatin at a coverage of 3.0 g/m$^2$.

A photographic material (B) according to the invention was prepared in a similar way as control sample (A) with the exception that the protective top layer contained 36 mg/m$^2$ of anti-sludging compound I-1, the preparation of which is described hereinafter.

A photographic developer was prepared containing following ingredients potassium carbonate: 23.7 g
potassium sulphite:65.5 g
potassium bromide: 10 g
potassium hydroxide: 5.3 g
diethyleneglycol: 20 ml
hydroquinone: 20 g
1-phenyl-3-pyrazolidinone: 0.48 g
1-phenyl-5-mercapto-tetrazole: 30 mg
water to make: 1 .

In a first experiment sheets of photographic materials (A) and (B) were conveyed through 1 liter of the developing solution described above until the appearance of a sludge deposit; the total surface area passed through the solution was noted. Then the experiment was repeated with the passage of 10 m$^2$ through 1 liter of developer and then the concentration of metallic silver present in the solution was determined analytically. The results are presented in table 1.

TABLE 1

| Phot. Mat. | m$^2$ needed for sludge appearance | metallic Ag/l |
|---|---|---|
| A | 20 | 70 mg |
| B | 80 | 35 mg |

The results presented in table 1 clearly demonstrate the reduction of the sludge formation in the case of the photographic sample according to the invention.

PREPARATION OF COMPOUND I-1

To a suspension containing 61 g (0.3 mole) of 5-amino-1H-benzimidazole dichlorohydrate in a mixture of 450 ml of dry acetonitrile and 47 ml of dry pyridine was added whilst stirring a solution of 101.5 g (0.3 mole) of 2-(2,4-di-t.pentyl-phenoxy)-butyrylchloride dissolved in 130 ml of dry acetonitrile. Then the reaction mixture was refluxed for 10 hours whilst stirring. After filtration and concentration by evaporation, the residue was stirred with 1500 ml of water. The sticky precipitate was dissolved in 350 ml of acetone, and this solution was added slowly whilst stirring to 3500 ml of water. The resinous precipitate was dried and milled to a powder in a mortar. Yield: 117 g (82%); melting point: 135° C.

EXAMPLE 2

A photographic material (C) according to the invention was prepared in a similar way as sample (B) with the exception that the protective top layer contained anti-sludging agent I-7, the preparation of which is given hereinafter, instead of I-1 in a concentration of 25 mg/m$^2$. The concentration of metallic silver is determined in 1 liter of the same developer as in example 1 after a passage through of 10 m$^2$ of material (C) in comparison to control material (A). The results are summarized in table 2.

TABLE 2

| Phot. mat. | metallic Ag/l |
|---|---|
| A | 36 mg |
| C | 19 mg |

The results of table 2 illustrate the reduction of the slugde formation due to the presence of compound I-7 of the invention.

PREPARATION OF COMPOUND I-7

To a solution of 123 g (1 mole) of 5-mercapto-1,2,3-triazole sodium salt dissolved in 1500 ml of methanol were added whilst stirring 305 ml of cetylbromide and the reaction mixture was stirred for four hours. Then the precipitate was filtered off at room temperature and stirred for one hour in 1650 ml of a methanol/water (10/1) mixture. The precipitate was filtered off, washed with methanol and finally dried. Yield: 273 g (84%); melting point: 81° C.

We claims:

1. Photographic material comprising a support, at least one silver halide emulsion layer, and a non-light sensitive colloid layer, situated at the same side of the support and farther from said support than said emulsion layer, characterized in that said non-light sensitive layer contains an anti-sludging compound corresponding to following general formula (I):

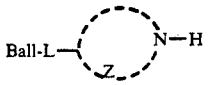

wherein:

Ball represents a ballast group preventing the diffusion of the compound out of the non-light sensitive colloid layer;

L represents a divalent linking group;

Z represents the necessary atoms to close a heterocyclic ring with the proviso that said heterocyclic ring contains no mercapto substituent.

2. Photographic material according to claim 1 wherein said ballast group is an aliphatic substituted or unsubstituted group containing at least nine carbon atoms.

3. Photographic material according to claim 1 wherein said ballast group is an aromatic nucleus bearing one or more substituted or unsubstituted alkyl groups containing alone or together at least five carbon atoms.

4. Photographic material according to claim 1 wherein said divalent linking group is a group chosen from the list of —O—, —S—, —CO—$NR_1$—, —$NR_2$—CO—$NR_3$—, —$SO_2$—$NR_4$—, —O—$CR_5R_6$—CO—NH— wherein each of $R_1$, $R_2$, $R_3$, $R_4$, $R_5$ and $R_6$ represents hydrogen, alkyl or aralkyl.

5. Photographic material according to claim 1 wherein said heterocyclic ring is chosen from the list of imidazole, benzimidazole, 1,2,3-triazole, 1,2,4-triazole, benzotriazole, tetrazole, indazole, uracil and hydantoin.

6. Photographic material according to claim 1 wherein said compound according to general formula (I) is 5-[2-(2,4-di-t.pentyl-phenoxy)-butyrylamino]-1-H-benzimidazole chlorohydrate.

7. Photographic material according to claim 1 wherein said compound according to general formula (I) is 5-cetylmercapto-1,2,3-triazole.

8. Photographic material according to claim 1 wherein said non-light sensitive colloid layer, situated at the same side of the support and farther from said support than said emulsion layer, is the top protective layer.

* * * * *